US005839368A

United States Patent [19]

Ohinata

[11] Patent Number: 5,839,368

[45] Date of Patent: Nov. 24, 1998

[54] INK SUPPLY SOURCE DEVICE FOR PRINTERS BY COLLAPSIBLE INK CONTAINER ENCASED IN REINFORCING CASE WITH DISK HANDLE HAVING PRESS CLAWS

[75] Inventor: Yoshiharu Ohinata, Tokyo, Japan

[73] Assignee: Riso Kagaku Corporation, Tokyo, Japan

[21] Appl. No.: 964,666

[22] Filed: Nov. 5, 1997

[30] Foreign Application Priority Data

Nov. 6, 1996 [JP] Japan ..... 8-310138

[51] Int. Cl.[6] ..... B41F 31/02

[52] U.S. Cl. ..... 101/364; 101/335; 347/86

[58] Field of Search ..... 101/364, 494, 101/335; 347/86; 15/347

[56] References Cited

U.S. PATENT DOCUMENTS

| | | | |
|---|---|---|---|
| 3,722,557 | 3/1973 | Huggins | 141/59 |
| 4,855,762 | 8/1989 | Suzuki | 347/86 |
| 5,187,498 | 2/1993 | Burger | 347/86 |
| 5,359,356 | 10/1994 | Ecklund | 347/86 |

FOREIGN PATENT DOCUMENTS

| | | | |
|---|---|---|---|
| 004109275 | 9/1992 | Germany | 206/261 |
| 25-3067 | 5/1925 | Japan . | |
| 59-37162 | 2/1984 | Japan . | |
| 59-37163 | 2/1984 | Japan . | |
| 60-94275 | 6/1985 | Japan . | |
| 62-3438 | 1/1987 | Japan . | |
| 62-82977 | 5/1987 | Japan . | |
| 404347653 | 12/1992 | Japan | 347/86 |
| 5-82858 | 4/1993 | Japan . | |
| 5-82858 | 11/1993 | Japan . | |
| 5-95878 | 12/1993 | Japan . | |
| 6-199349 | 7/1994 | Japan . | |
| 8-260334 | 10/1996 | Japan . | |
| 9-39712 | 2/1997 | Japan . | |

*Primary Examiner*—Edgar S. Burr
*Assistant Examiner*—Anthony H. Nguyen
*Attorney, Agent, or Firm*—Oliff & Berridge, PLLC

[57] ABSTRACT

To remarkably decrease the amount of material for the manufacture of ink containers and the volume of the ink containers after use, so as to contribute to the economy of natural resource consumption and solving the problem of destruction of global environment by the waste of products, without sacrificing the easiness of handling the ink containers for printers, the ink container for directly storing ink is principally constructed by a thin walled vessel contractible according to discharge of the ink therefrom, with a nozzle being connected to an end portion of the vessel, with a disk handle being mounted to the nozzle, so that the disk handle can be grasped by five fingers of a hand for carrying the ink container by hand and for removing a cap therefrom. For the ink container being mounted into a printer, the ink container is mounted into a reinforcing case with the nozzle and the disk handle, so that the ink container is handled like the case. The disk handle is equipped with press claws adapted to engage a portion of the case for easily guiding the ink container relative to the case and stabilizing the mounted state of the ink container in the case.

4 Claims, 7 Drawing Sheets

INK SUPPLY SOURCE DEVICE FOR PRINTERS BY COLLAPSIBLE INK CONTAINER ENCASED IN REINFORCING CASE WITH DISK HANDLE HAVING PRESS CLAWS

BACKGROUND OF THE INVENTION

1. Field of the Invention

The present invention relates to the art of printer, and more particularly, to an ink supply source device for printers.

2. Description of the Prior Art

In a printer for automatically continuously printing a large number of prints, such as a rotary type stencil printer, the ink consumed according to the progress of printing is continuously supplied from an ink container mounted in the printer. As an ink container for this purpose, there is known an ink container having a cylinder portion of a circular cross section, an end plate member mounted into the cylinder from one open end thereof so as to be able to slide therein along the central axis of the cylinder like a free piston, and an annular end wall closing the other end of the cylinder except a central opening, and a nozzle connected to the central opening, the inside of the cylinder being initially filled with ink, with the end plate positioned at the open end, such that the end plate moves axially in the cylinder toward the other end as the ink in the cylinder is drawn out through the nozzle, as shown in Japanese Patent Laid-open Publication 59-37162. When a printer is operated with an ink container of this construction, the resistance against the drawing out of the ink from the ink container remains always constant regardless of the amount of ink remaining in the container, whereby a large number of prints are available at a continuously stabilized density.

In the ink container of the above-mentioned construction, since the cylinder portion must operate not only as a wall means of a container for storing ink therein but also as a cylinder member for smoothly guiding the end plate member along the inside wall thereof like a free piston, the cylinder portion forming a principal portion of the ink container must have such a wall thickness that provides a high rigidity enough to operate as a cylinder for guiding a free piston therein, and therefore, a substantial amount of a material such as a synthetic resin or the like is required for the manufacture of the ink container, and further, the used ink container presents substantially the same outer configuration as that in its initial stage, although the end plate member is shifted to the deepest position of the cylinder close to the nozzle. Therefore, when the number of the used ink containers increases according to the increase of working hours of the printer, a difficulty would arise about the disposal of the used ink containers.

It is well known from old days that a fluid storing container is constructed to have a bellows construction. Particularly in Japanese Utility Model Application 60-94275 (Laid-open Publication 62-3438), there is proposed a container having a cylindrical portion of a bellows construction having a closed one end and another end having an opening, and a nozzle connected to the opening. Further, it is shown in Japanese Patent Laid-open Publication 6-199349 to construct a bellows type ink container for a printer such that an inner cylinder of a bellows construction projects from an end of a main cylinder portion toward the inside thereof, such that the amount of the ink which remains in the ink container after the end of a possible discharge of ink therefrom is decreased.

However, if the wall thickness of the cylinder portion of those known containers of a bellows construction is substantially reduced relative to the diameter thereof in order to decrease the amount of material required for the manufacture and the volume for disposal after the use thereof, the container is, when filled with ink charged therein, and even when the open end of the nozzle was sealed by an appropriate cap or the like, will be very poor in the easiness of manual handling.

In more detail, the thin walled cylinder portion of a bellows construction made of a soft synthetic resin readily flattens in its cross section when clamped by fingers, so as to escape from the pressing force by the fingers, thereby nullifying the clamping action by the fingers. When the thin walled cylinder portion made of a soft synthetic resin is simply cylindrical with no bellows construction, the difficulty in clamping would be much far. When the container is only to be lifted up, the cap may be clamped by fingers. However, for mounting the container filled with ink into a printer, the cap must be removed from the container. In order to remove the cap tightly fastened to avoid any ink leakage, the cylinder portion must be firmly held against a force applied to the cap for removal.

SUMMARY OF THE INVENTION

In view of the necessity of a relatively large amount of material for the manufacture of the conventional rigid type ink containers and the difficulty of the disposal of the used containers, and further in order to meet with the problem that if the conventional bellows type ink container is made to have a substantially thin wall for further saving the material for constructing the ink container and for further decreasing the volume of the container after use, the easiness of handling the ink container is substantially deteriorated, it is a primary object of the present invention to provide an ink supply source device for a printer that is not inferior in the easiness of handling by hand in spite of a thin walled construction, as combined with a rigid reinforcing case, so as to provide an ink supply source device equivalent to the conventional rigid ink container in the easiness of mounting and dismounting thereof into and out of the printer, by further incorporating therein a guide means for definitely and stably mounting the ink container into the reinforcing case.

According to the present invention, the above-mentioned object is accomplished by an ink supply source device for a printer, comprising a combination of an ink container having a flexible vessel expansible to be substantially cylindrical by ink being charged therein and contractible to substantially reduce an outer configuration thereof by the ink being discharged therefrom, a nozzle connected to an end portion of said vessel for defining an ink outlet port of said vessel, and a disk handle mounted to said nozzle, and a reinforcing case for accommodating said vessel and said disk handle of said container, wherein said disk handle has a press claw at a circumferential portion thereof so as to engage with a portion of said reinforcing case for fastening said ink container to said reinforcing case when said container was charged into said reinforcing case.

In co-pending U.S. patent application Ser. No. 18/925,477 filed on 8 Sep., 1997 by claiming the Convention priority of Japanese Patent Application Heisei 8-260334 by the same applicant as the present application, the present inventor proposed an ink supply source device for a printer assembled from an ink container comprising a flexible vessel expansible to be substantially cylindrical by ink being charged therein and contractible to substantially reduce an outer configuration thereof by the ink being discharged therefrom, a nozzle connected to an end portion of said vessel for defining an ink outlet port of said vessel, and a disk handle mounted to said nozzle, and a reinforcing case for receiving at least said vessel of said ink container.

According to the above-mentioned proposal, since the ink container is provided with the disk handle mounted to the nozzle, when the cap is removed by grasping it by one hand, the other hand may grasp the disk handle. By providing such a disk handle, a handle of the same shape is always available for grasping regardless of the rotational state of the ink container. Such a disk handle conveniently functions not only for removing the cap but also for carrying the ink container by grasping the disk handle by five fingers.

Further, by the ink container of the above-mentioned construction being combined with the reinforcing case which accommodates at least the vessel of the ink container when it is mounted into a printer, only one reinforcing case can serve for all ink containers used for the printer in succession, and therefore the volume of the disposal generated after the consumption of the ink is contracted to a very small volume substantially occupied by the contracted vessels made of a very small amount of synthetic resin, while providing the convenience that the mounting and dismounting of the ink supply source device into and out of a printer are always done with the reinforcing case.

Although the disk handle mounted to the nozzle has a function of substantially facilitating the removal of the cap and the handling of the ink container by hands when the ink container is viewed as an independent article, when the ink container equipped with the disk handle is combined with the reinforcing case to provide an ink supply source device for a printer, the disk handle functions also as a means for definitely positioning the ink container relative to the reinforcing case and can be utilized as a guide and engagement means for stably mounting the ink container in the reinforcing case.

In this connection, particularly when the press claw is provided at a portion of the circumference of the disk handle as described above, so that, when the ink container was mounted into the reinforcing case, the press claw engages a portion of the reinforcing case so as to fasten the ink container to the reinforcing case, the portion of the reinforcing case is clamped between the press claw and the body of the disk handle so as to generate a slide contact therebetween during a process of mounting the ink container into the reinforcing case, thereby stably and definitely guiding the ink container relative to the reinforcing case, while, when the ink container was mounted into the reinforcing case, the condition of the ink container mounted in the reinforcing case is definitely and stably maintained by the press claw clamping a portion of the reinforcing case.

Further, when the press claw is provided as a pair at opposite side edge portions of the disk handle so as to extend in parallel with each other, while the reinforcing case has a construction of two case halves of a shape of longitudinally severed cylinder half being connected with each other by hinge means along longitudinal edges thereof adjacent to each other, with certain wall portions of one of the case halves accommodating the disk handle being biased inward, such that the pair of press claws engage in slide contact with the inward biased wall portions of said one case half from outside thereof when the ink container is mounted into said one case half, the pair of press claws effectively function as a guide means for correctly and smoothly guiding the ink container relative to said one case half in a radial direction thereof to a predetermined mounting position of the ink container.

Further, by the press claws having each a projection for engagement at a portion thereof facing the outside of the inward biased wall portion of said one case half, while the outside of the inward biased wall portions are each formed with a dent to receive the projection for engagement of each corresponding one of the press claws when the ink container was mounted into said one case half, the ink container is mounted into the reinforcing case at a predetermined mounting position, such that the ink container is stably fastened to the mounting position by the projections for engagement being each received in the corresponding one of the dents, so that it is definitely avoided that a trouble occurs that the ink container moves irregularly relative to said one case half during a process of closing the other case half onto said one case half.

BRIEF DESCRIPTIONS OF THE DRAWING

In the accompanying drawings.

DESCRIPTION OF THE EMBODIMENTS

In the following, the present invention will be described in more detail with respect to some embodiments with reference to the accompanying drawings.

Figure 1:
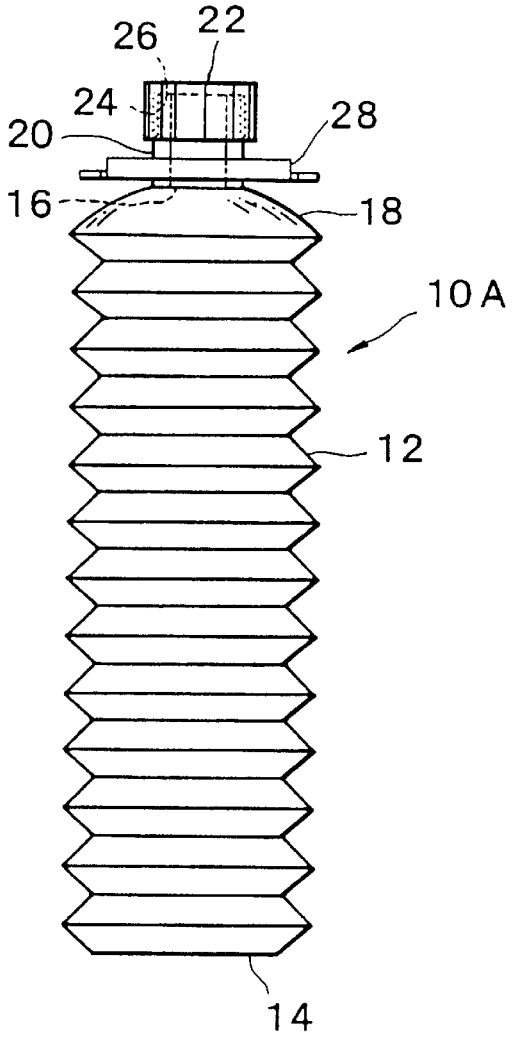
FIG. 1 is a side view showing a first embodiment of the ink container for constructing the ink supply source device according to the present invention, together with a cap.
Figure 2:
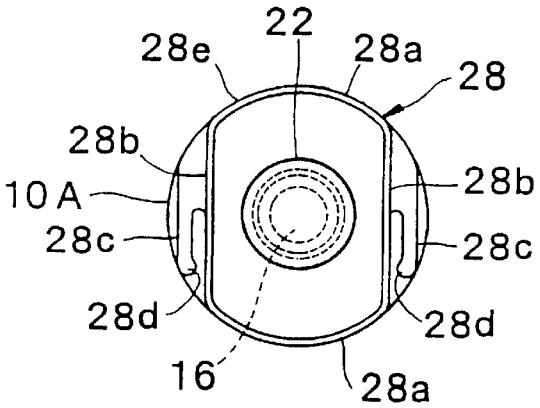
FIG. 2 is a plan view of the capped ink container shown in FIG. 1.
Figure 3:
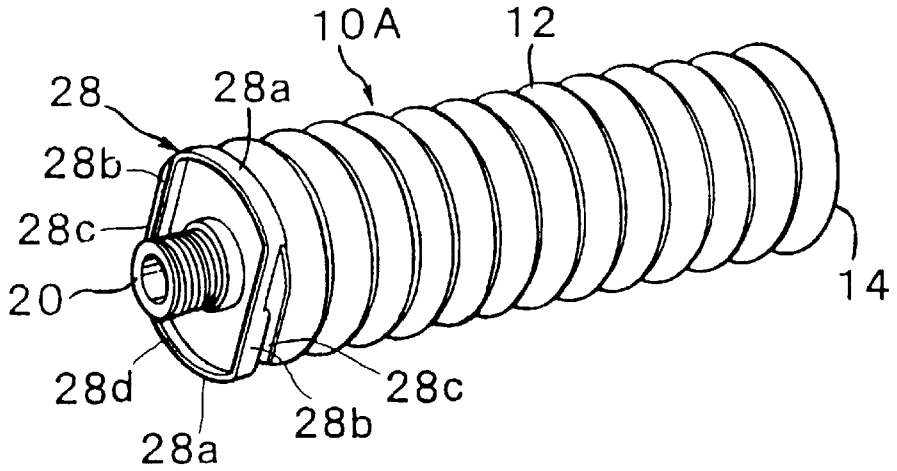
FIG. 3 is a perspective view of the ink container shown in FIGS. 1 and 2.

Referring to FIGS. 1–3, the ink container generally designated by 10A includes a vessel made of a cylindrical portion 12 of a bellows construction, an end wall portion 14 closing one end (lower end in FIG. 1) of the cylindrical portion and an annular end wall portion 18 extending from the other end (upper end in FIG. 1) of the cylindrical portion to a central opening 16, and a cylindrical nozzle 20 connected to the central opening 16. In the condition shown in FIGS. 1 and 2, a cap 22 is mounted around the open end of the nozzle 20. In this embodiment, the cap 22 is fastened by the engagement of male threads 24 formed around the tip end portion of the nozzle 20 and female threads 26 formed along the inside of the cap, so as to close the tip opening of the nozzle. The cap 22 is provided to hold an ink charged condition of the ink container, and is removed from the nozzle 20 prior to the use of the ink container. The time desirable for removing the cap will be described later.

A disk handle 28 is mounted to the nozzle 20. As shown in the figures, the disk handle 28 has a body portion of an elliptical shape defined by a pair of arcuate edges 28*a* and a pair of straight edges 28*b* extending between the pair of arcuate edges and a pair of press claws 28*c* extending along the straight edges 28*b*. The elliptical body portion is formed with an annular rib 28*e* for increasing the thickness of the peripheral portion thereof, in order to increase the rigidity of the disk handle, and for more stabilizing the sliding engagement of the disk handle with the reinforcing case. The disk handle 28 is provided at a root portion of the nozzle 20, i.e. the connecting portion of the nozzle with the annular end wall portion 18 of the container.

Although it was described in the above that the ink container 10A has a cylindrical portion 12, a closed end portion 14 and an annular end portion 18, that the nozzle 20 is connected to the annular end portion 18, and that the disk handle 28 is connected to the nozzle 20, these descriptions are for the explanation of the respective portions of the ink container. The cylindrical portion 12, the end wall portions 14 and 18, the nozzle 20 and the disk handle 28 may be formed to be all integral by a single material, particularly a soft synthetic resin. In this case, the cylindrical portion 12 of a bellows construction forming a principal portion of the ink container is made to have a necessary minimum thickness to function as an ink storing container, so that the material is saved as much as possible and the mass and the volume to be disposed after the consumption of the ink is suppressed to a minimum. The thickness of the end wall portions 14 and 18 may be of the same order as that of the cylindrical portion 12. However, since a certain rigidity is required for the annular end wall portion 18, it is desirable that the annular end wall portion 18 is formed to have a spherical construction as in the shown embodiment, so that its rigidity is increased relative to its thickness. The rigidity of the annular end portion 18 may be given by a provision of appropriate ribs in place of or in addition to the spherical construction. The bellows of the cylindrical portion 12 may be constructed to retain the contracted stage by itself, as shown in the above-mentioned Japanese Patent Laid-open Publication 6-199349. Further, the end wall portion 14 may be provided with an inside bellows cylinder for decreasing the amount of ink remaining after the use, as also shown in said publication.

Further, instead of being formed integrally with the nozzle 20, the disk handle 28 may be formed separately from the principal portion of the ink container including the nozzle 20 and mounted to the nozzle 20 by thermal welding, adhesive, or a screw ring or a spline engagement.

As described above, it is desirable that the cylindrical portion 12 of a bellows construction is made to have a minimum thickness necessary to function as an ink storing container. Even when such a bellows construction is made to have a thin wall of a soft synthetic resin, when ink is filed therein, with the open end of the nozzle 20 being sealed by the cap 22, the ink, an incompressible fluidal material, maintains a constant volume by itself, so that, in spite of a relatively high flexibility of the bellows construction having a thin wall thickness, the bellows shape of the cylindrical portion 12 does not substantially change if the ink container is suspended at the nozzle 20 positioned at the upper end of the ink container for a transportation.

Since the disk handle 28 is mounted to the nozzle 20 according to the present invention, taking out of the ink container from a storing box and mounting it into a printer are readily done by grasping the ink container at the disk handle 28 by five fingers of a hand.

Figure 4:
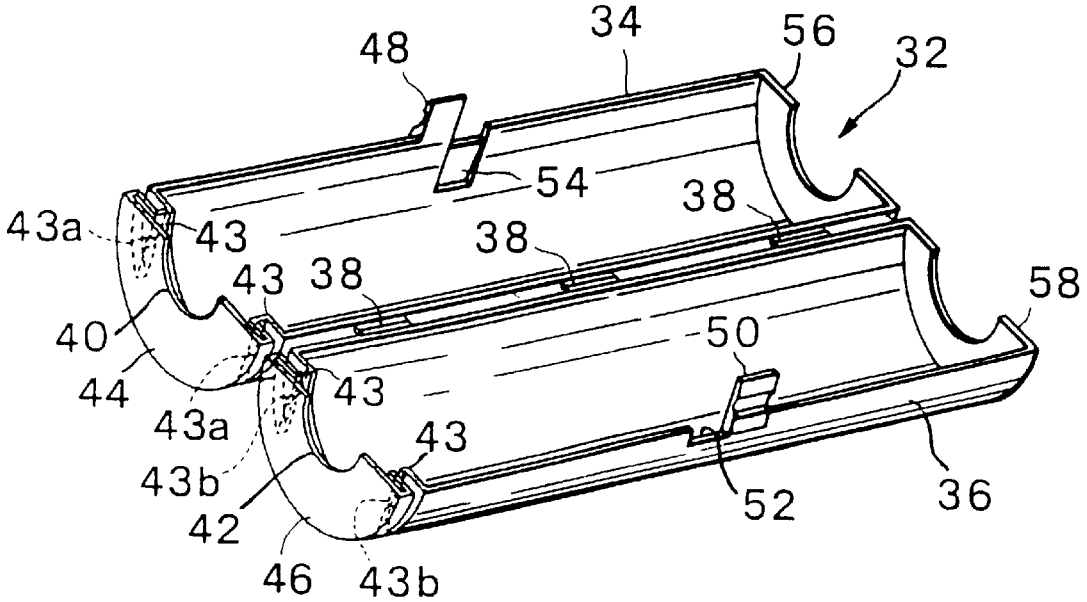
FIG. 4 is a perspective view showing an embodiment of the case for constructing the ink supply source device according to the present invention with case halves being opened.
Figure 5:
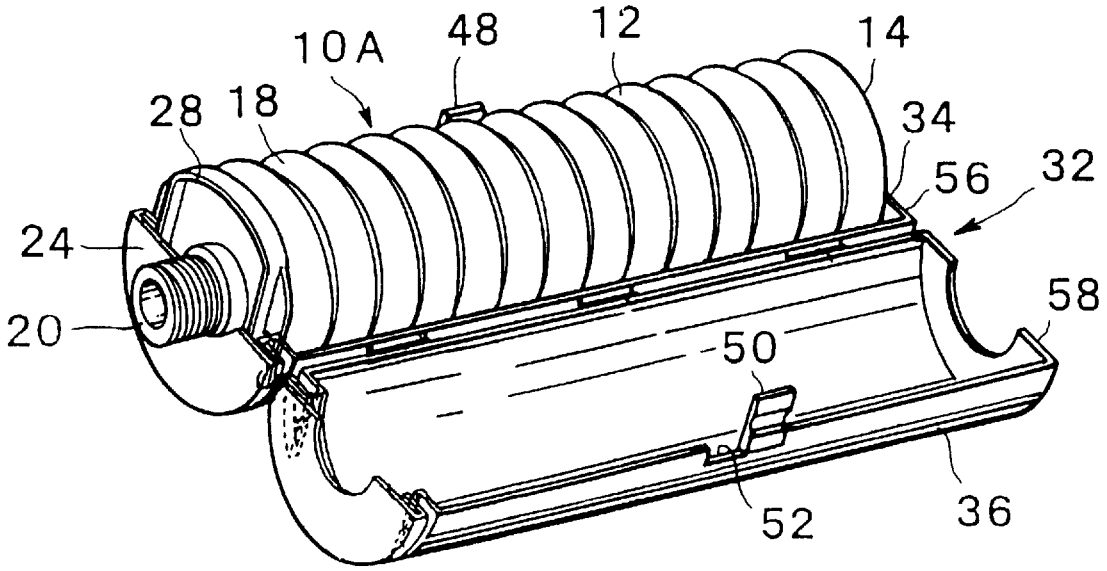
FIG. 5 is a perspective view showing the ink container shown in FIG. 3 as placed in the case in the state shown in FIG. 4.
Figure 6:
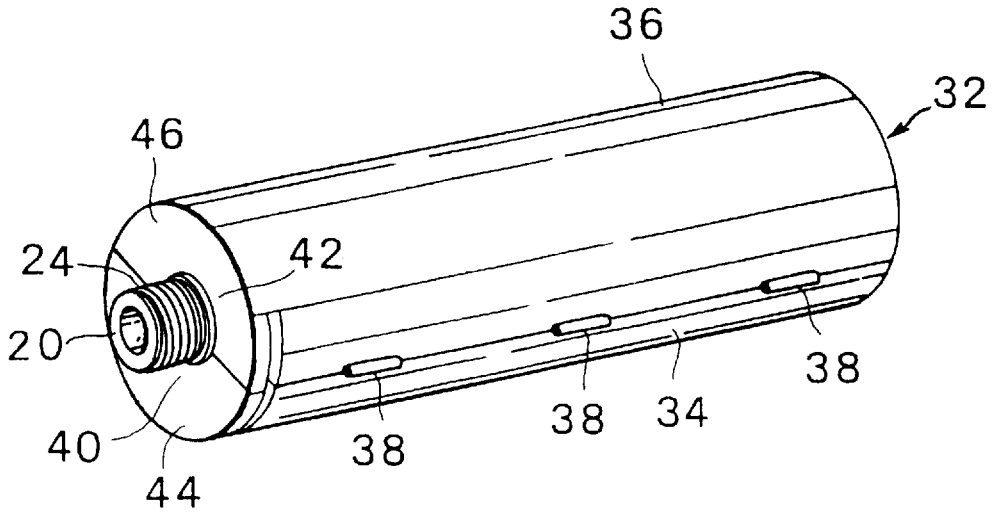
FIG. 6 is a perspective view showing the case of FIG. 4 with the ink container of FIG. 3 completely housed therein.

FIG. 4 is a perspective view of an embodiment of a reinforcing case adapted to be combined with the ink container for mounting the ink container into a printer with a higher easiness and precision, FIG. 5 is a perspective view showing a stage of mounting the ink container in the case, and 6 is a perspective view of the case in the condition that the mounting of the ink container therein has been completed. It is desirable that the cap 22 is removed from the ink container 10A after the cylindrical portion 12 of the ink container has been settled in the case as shown in FIG. 5, or more desirably after the reinforcing case has been completely closed as shown in FIG. 6. For removing the cap in the stage shown in FIG. 5, the disk handle 28 or the case halve 34 may be held by one hand, and for removing the cap in the stage shown in FIG. 6, the case 32 may be held by one hand.

In these figures, the case generally designated by 32 presents a cylindrical configuration of a circular cross section in the state of use. However, in the shown embodiment, the case is constructed from two case halves 34 and 36 into which the cylinder is separated by a phantom plane including the central axis of the cylinder, and hinge means 38 for connecting the two case halves to be pivotable relative to one another along a longitudinal edge of each of the case halves adjacent to one another. In the shown embodiment, the hinge means 38 is separated into three pieces. The case halves 34 and 36 are shaped just to enclose the cylindrical portion 12 of the bellows construction and the disk handle 28 of the ink container 10A when they are closer together into a cylindrical configuration.

The case half 34 and 36 have half circular end wall portions 44 and 46 formed with half circular notches 40 and 42, respectively, for passing the nozzle 20 of the ink container therethrough, and disk handle guide portions 43 formed adjacent to the end wall portions 44 and 46 by a portion of each of the case halves being biased radially inward in a U-shape.

The opposing inside faces of a pair of the disk handle guide portions 43 provided in each of the case halves 34 and 36 are disposed to be apart from and in parallel to one another for a distant for lightly slidingly accommodating the straight edge portions 28*b* of the disk handle 28. Further, the outside faces of the pair of disk handle guide portion 43 of the case half 34 are each formed with a dent for engagement 43*a*, while the pair of disk handle guide portions 43 of the case half 36 are each formed with a slit 43*b*. Each of the dents for engagement 43*a* engages with a projection for engagement 28*d* formed in each of the pair of press claws 28*c* formed of the disk handle 28.

For charging the ink container 10A into the reinforcing case 32, the case halves 34 and 36 are opened along the hinges 38 as shown in FIG. 5, and the ink container 10A is mounted into the case half 34 such that the straight edge portions 28*b* of the disk handle 28 are slid along the inside faces of the disk handle guide portions 43. When the disk handles 28 move downward in sliding contact with the inside faces of the disk handle guide portions 43, the projections for engagement 28*c* slide along the outside faces of the disk handle guide portions 43, with the disk handle guide portions 43 each being clamped between the corresponding straight edge portion 28*b* of the disk handle and the corresponding press claw 28*c*. When the ink container 10A reaches the predetermined mounting position, the projections for engagement 28*d* provided at the tip ends of the press claws 28 engage into the dents for engagement 43*a* formed in the outside faces of the disk flange guide portions 43 with a "click" under the elasticity of the press claws 28*c*, so that the operator is definitely informed that the ink container 10A has been correctly mounted into the case half 34, ensuring that the operation of mounting the ink container 10A first to the case half 34 has been correctly accomplished. Further, such an elastic engagement between the projections for engagement 28*d* and the dents for engagement 43*a* maintains the condition that the ink container 10A is correctly mounted into the case half 34.

Further, when the case half 36 is closed onto the case half 34 as shown in FIG. 6, the disk handle guide portions 43 of the case half 36 align and engage with upper half portions of the straight edge portions 28*b* of the disk handle 28, while receiving upper half portions of the press claws 28*c* in the slits 43*b*, thereby aligning the nozzle 20 of the ink container to be coaxial with the case 32, while specifying and maintaining a predetermined axial position of the nozzle relative to the case. The case halves 34 and 36 are formed with elastic engagement tongues 48 and 50, respectively, which are adapted to elastically meet with engagement grooves 52 and 54 formed in the other of the case halves, respectively, so as to maintain the cylindrically closed state of the case halves. In the shown embodiment, the case halves 34 and 36 are formed with half annular end wall portions 56 and 58 at the other ends thereof, respectively.

Figure 7:
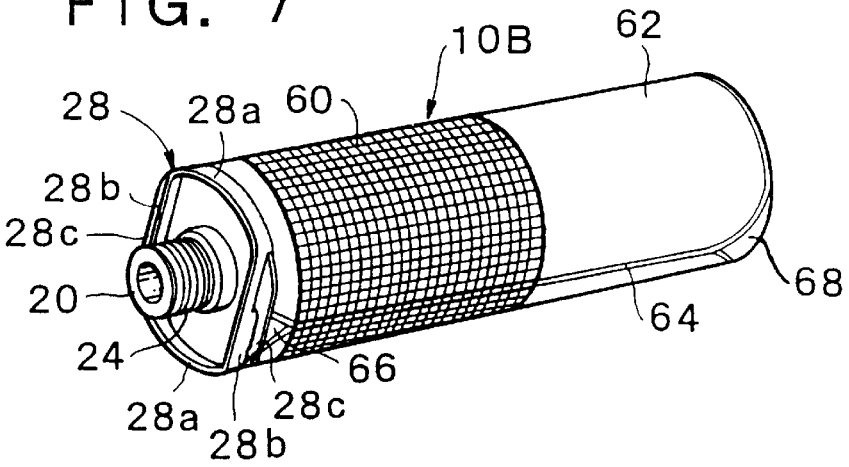
FIG. 7 is a perspective view showing a second embodiment of the ink container according to the present invention.
Figure 8:
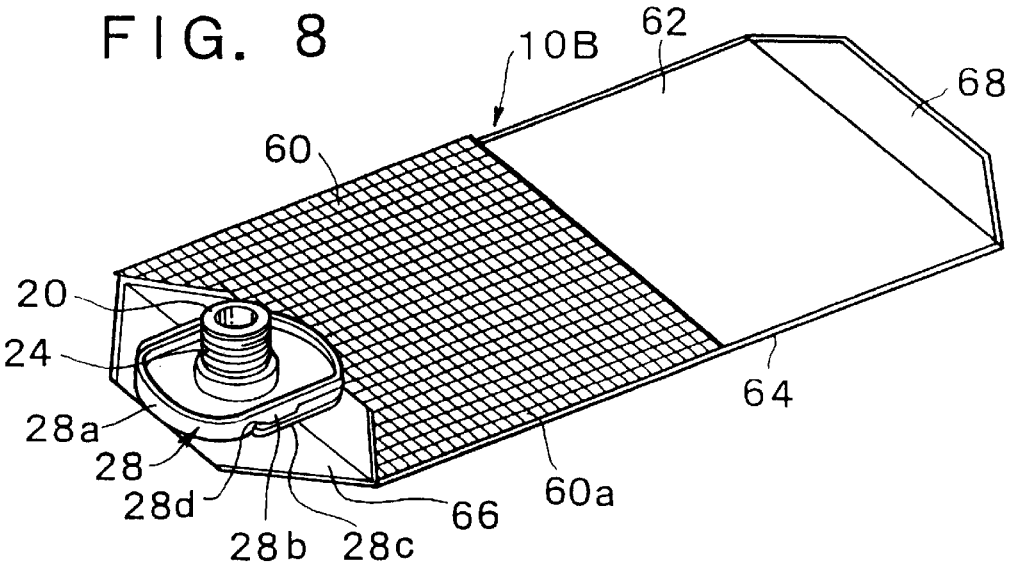
FIG. 8 is a perspective view showing the ink container of FIG. 7 in a flattened state thereof.

FIG. 7 is a perspective view showing another embodiment of the ink container constructed according to the present invention, with a vessel proposed by the above-mentioned Japanese Patent Application 9-29712. It is to be noted that the ink container 10B shown in FIG. 7 is in a condition filled with ink charged therein, and that, when the ink is discharged therefrom, the ink container is collapsed to a flat shape as shown in FIG. 8. In the container 10B of the second embodiment, the portions corresponding to those of the ink container 10A of the above-mentioned first embodiment are designated by the same reference numerals as in the first embodiment.

In the ink container 10B of this second embodiment, the nozzle 20 and the disk handle 28 are constructed to have the same constructions as those of the ink container 10A of the first embodiment. The nozzle 20 is connected with a vessel having a flatly collapsible cylindrical body 60 made of a relatively hard sheet material and a flatly collapsible bag 62 made of a soft sheet material and passed through the cylindrical body 60 at a portion thereof (about a half in the shown embodiment). The inside of the bag 62 is open to the outside through the nozzle 20. The bag 62 is made of two sheets placed one over the other with peripheral portions thereof connected with one another along a seal edge 64, with opposite end portions thereof being constructed as folded portions 66 and 68, which, when the bag 62 was charged with ink, expand to construct end wall portions of the cylindrical bag, whereby a generally cylindrical vessel having a circular cross section is formed as shown in FIG. 7.

The bag 62 is fixed to the inner peripheral surface of the cylindrical body 60 along a periphery thereof at a generally axial mid portion thereof.

In the second embodiment shown in FIGS. 7 and 8, the cylindrical body 60 is made of one sheet folded with a half thereof laid over the other half thereof and the opposite ends 60*a* are sealed together with the sheet material constructing the bag 62 so as to form a sealed edge 64 together therewith.

Figure 9:
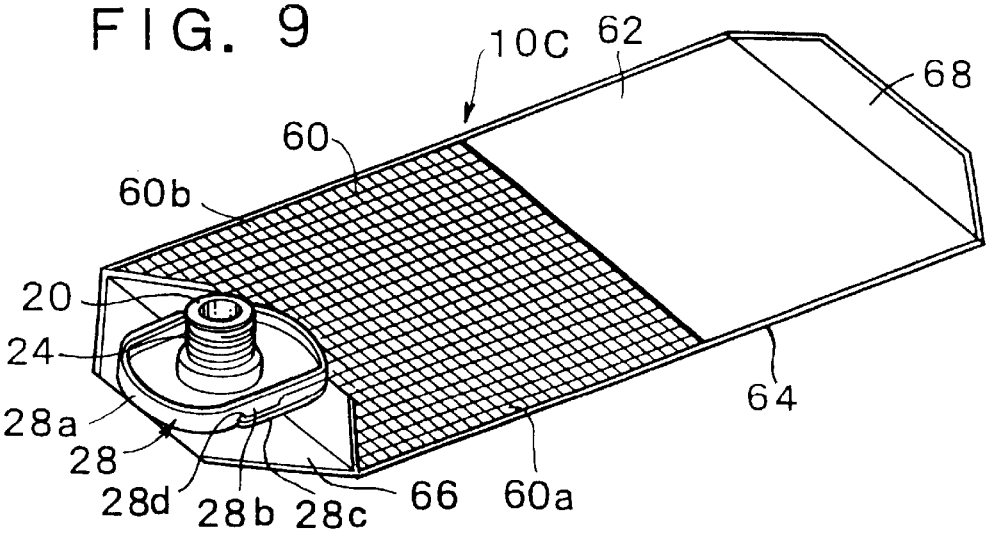
FIG. 9 is a perspective showing a third embodiment of the ink container according to the present invention in a flattened state thereof.

FIG. 9 is a view similar to FIG. 8, showing a third embodiment modified from the second embodiment shown in FIG. 8. In the ink container 10C of this third embodiment, the cylindrical body 60 is made of two sheets laid one over the other, with opposite overlaid edge portions 60*a* and 60*b* being sealed together with the sheet material forming the bag 62 to form the sealed edge 64 together therewith. It will be apparent that the ink container 10C of the third embodiment presents substantially the same outer configuration as that shown in FIG. 7 when the inside thereof was filled with ink.

Figure 10:
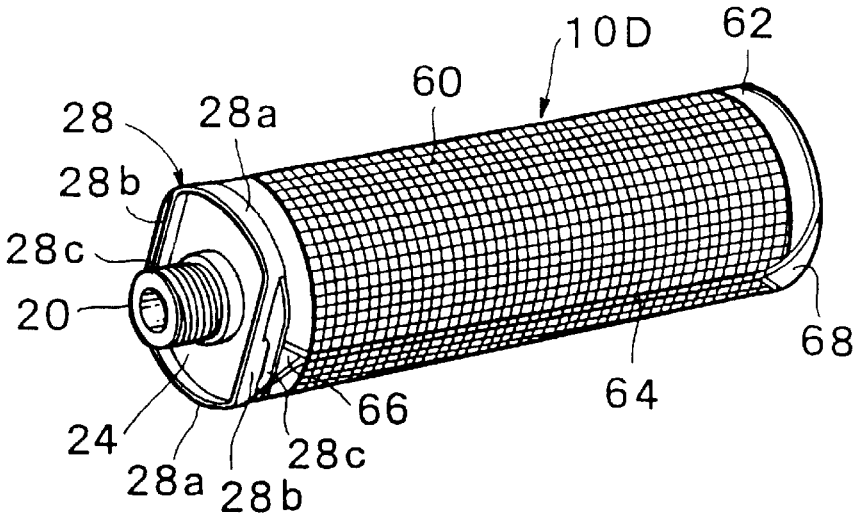
FIG. 10 is a perspective view showing a fourth embodiment of the ink container according to the present invention.
Figure 11:
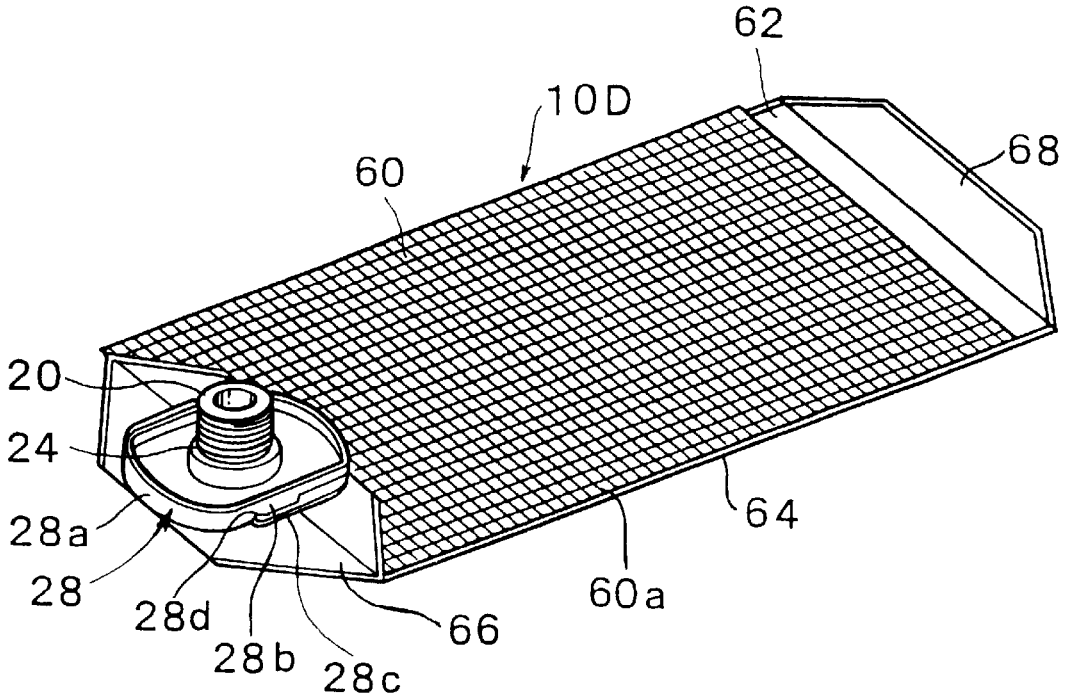
FIG. 11 is a perspective view showing the ink container of FIG. 10 in a flattened state thereof.

FIG. 10 is a perspective view similar to FIG. 7, showing a fourth embodiment of the ink container, 10D, and FIG. 11 is a view similar to FIGS. 8 and 9, showing a condition that the ink container 10D was collapsed flatly. In this fourth embodiment, the portions corresponding to those of the second and third embodiments shown in FIGS. 7–9 are designated by the same reference numerals as in FIGS. 7–9. This fourth embodiment is different from the second embodiment shown in FIGS. 7 and 8 only in that the axial length of the cylindrical body 60 is made longer so as to cover almost the whole length of the bag 62. In this fourth embodiment, the bag 62 is also fixed to the cylindrical body 60 at a generally axial mid portion thereof.

Figure 12:
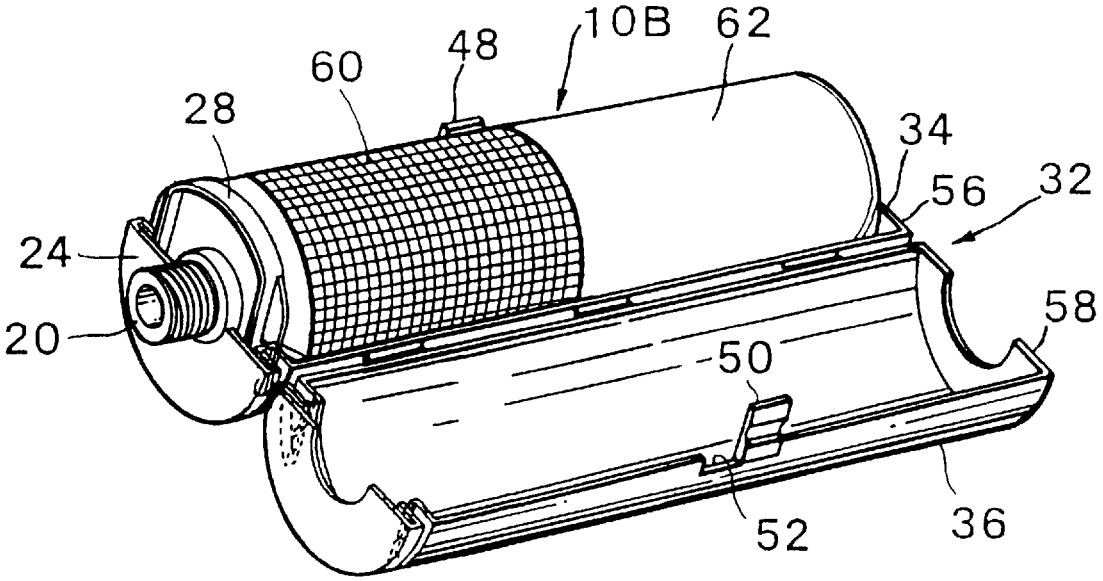
FIG. 12 is a perspective view showing the ink container of FIG. 7 as mounted in the same case as that shown in FIG. 4.

FIG. 12 is a view similar to FIG. 5, in which the ink container 10B of the second embodiment shown in FIG. 7 was placed in the same case as that shown in FIG. 4. In FIG. 12, the portions corresponding to those shown in FIGS. 4 and 5 are designated by the same reference numerals. In this case also, when the ink container 10B is placed in the case half 34 as shown in FIG. 12, and when the case half 36 is closed over the case halve 34, a cased ink container having exactly the same outside view as the cased ink container shown in FIG. 6 is obtained.

Figure 13:
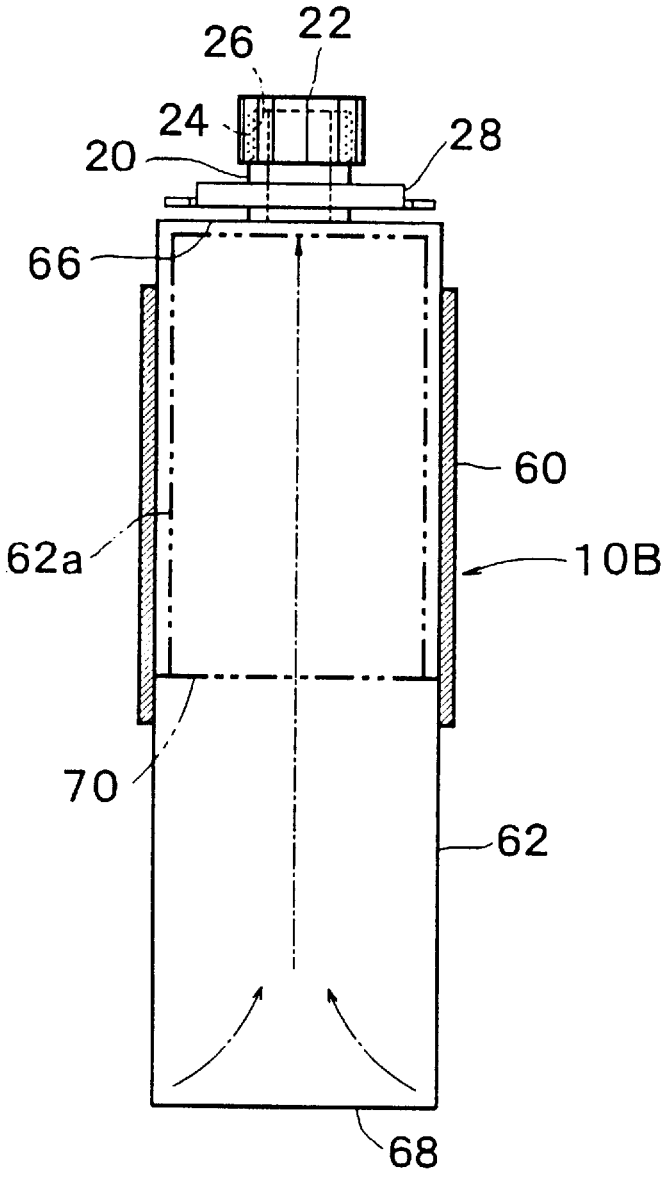
FIG. 13 is a side view of the ink container shown in FIG. 7, diagrammatically illustrating the manner of deformation of the ink container when the ink charged in the ink container has been discharged therefrom.

FIG. 13 is a side view similar to FIG. 1 with regard to the ink container 10A of the first embodiment, showing the ink container 10B of the second embodiment shown in FIG. 7 in the same manner as in FIG. 1, provided that in FIG. 13 the cylindrical body 60 is shown in the longitudinal cross section, and further the thickness of the sheet material constructing the cylindrical body 60 is magnified relative to the longitudinal and lateral dimensions of the ink container for the clarity of illustration. Further, the opposite end portions of the bag 62 constructed by the folded portions 66 and 68 are simplified like an end wall configuration of a simple cylindrical body. In FIG. 13, the portions corresponding to those shown in FIG. 1 are designated by the same reference numerals as in FIG. 1.

Further, in FIG. 13, the manner of deformation of the bag 62 according to the discharge of ink from the ink container 10B through the nozzle 20 is diagrammatically illustrated. As described above, the bag 62 is fixed at an annular portion 70 located at an axially mid position thereof to the inner peripheral surface of the cylindrical body 60. Therefore, according to the progress of discharge of the ink from bag 62 through the nozzle 20, a half portion of the bag 62 on the side opposite to the nozzle 20 is gradually drawn toward inside of the cylindrical body 60 to be finally received in the inside of the cylindrical body 60 as turned over inside out as shown by a phantom line 62*a* in the figure, so that almost all ink charged in the bag 62 is exhausted therefrom through the nozzle 20.

In the fourth embodiment shown in FIGS. 10 and 11, the bag 62 is also fixed to the inner peripheral surface of the cylindrical body 60 at a generally mid position of the length thereof in the same manner as shown in FIG. 13, so that according to the progress of discharge of the ink from the bag 62, the bag is finally received within a half portion of the cylindrical body 60, with a half of the bag being turned over inside out in the same manner as shown in FIG. 13.

As will be apparent from the foregoing descriptions, according to the present invention, the totally cylindrical container device to be charged into a printer as an ink supply source device is provided substantially in the same rigid cylindrical configuration as in the conventional totally rigid ink container, while nevertheless the consumption of the manufacturing material for the ink container proportional to the amount of consumption of the ink and the mass and the volume of the used containers to be disposed are extremely decreased relative to those of the conventional rigid containers. The case for providing a rigid container configuration as a whole remains constantly one, regardless of the amount of consumption of ink, while the ink containers proportional to the amount of consumption of ink constructed with vessels having a very thin wall thickness bring about the reduction of the material for manufacture to one tenth or less as compared with the conventional rigid containers. Further, the vessels contract after the consumption of the ink charged therein so that the outer volume thereof contracts to one tenth or less, thereby decreasing the bulk of the remaining containers to be disposed to one tenth or less as compared with the conventional containers.

The above-mentioned distinguished improvements with respect to the economy of the material in the manufacture of the containers as an ink supply source device for a printer and the issue of global environment are accomplished without substantially sacrificing the easiness of handling of the ink container by the disk handle being mounted to the nozzle for the thin and substantially contractible vessel forming the principal body of the ink container, and also without sacrificing the easiness of mounting and dismounting the ink supply source device into and out of a printer, by the ink container principally constructed by the thin walled vessel being combined with the reinforcing case as mounted therein at high precision and stability, while precluding complexity or mistake in mounting the ink container into the reinforcing case, by the ink container being conveniently and precisely guided relative to the reinforcing case with the disk handle having the press claws adapted to correctly guide the disk handle relative to the reinforcing case.

Although the invention has been described in detail with respect to several preferred embodiments thereof, it will be apparent to those skilled in the art that various modifications are possible with respect to the shown embodiments without departing from the scope of the present invention.

What is claimed is:

1. An ink supply source device for a printer, comprising a combination of an ink container having a flexible vessel expansible to be substantially cylindrical by ink being charged therein and contractible to substantially reduce an outer configuration thereof by the ink being discharged therefrom, a nozzle connected to an end portion of said vessel for defining an ink outlet port of said vessel, and a disk handle mounted to said nozzle, and a reinforcing case for accommodating said vessel and said disk handle of said container, wherein said disk handle has a press claw at a circumferential portion thereof so as to engage with a portion of said reinforcing case for fastening said ink container to said reinforcing case when said container is mounted into said reinforcing case.

2. An ink supply source device for a printer according to claim 1, wherein said press claw is provided as a pair at opposite side edge portions of said disk handle so as to extend in parallel with each other, and said reinforcing case has a construction of two case halves in the shape of a longitudinally severed cylinder half being connected with each other by hinge means along longitudinal edges thereof adjacent to each other, with certain wall portions of one of said case halves accommodating said disk handle being biased inward, such that said pair of press claws engage in slide contact with said inward biased wall portions of said one case half from outside thereof when said ink container is charged into said one case half.

3. An ink supply source device for a printer according to claim 2, wherein said press claws each have a projection for engagement at a portion thereof facing the outside of said inward biased wall portion of said one case half, while the outside of said inward biased wall portions are each formed with a dent to receive said projection for engagement of each corresponding one of said press claws when said ink container is charged into said one case half.

4. An ink supply source device according to claim 2, wherein the other of said two case halves has inward biased wall portions for engaging with a portion of said disk handle, said inward biased wall portions of said other case half being each formed with a slit to receive a part of each corresponding one of said pair of press claws.

* * * * *